US006868241B2

(12) United States Patent
Takami

(10) Patent No.: US 6,868,241 B2
(45) Date of Patent: Mar. 15, 2005

(54) IMAGE FORMING SYSTEM AND IMAGE FORMING METHOD FOR DECIDING AC VOLTAGE TO BE APPLIED TO CHARGER

(75) Inventor: Hiroshi Takami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/617,052

(22) Filed: Jul. 11, 2003

(65) Prior Publication Data

US 2004/0013439 A1 Jan. 22, 2004

(30) Foreign Application Priority Data

Jul. 16, 2002 (JP) ..... 2002-207551

(51) Int. Cl.[7] ..... G03G 15/02

(52) U.S. Cl. ..... 399/50; 399/176

(58) Field of Search ..... 399/50, 168, 174, 399/176, 175, 170; 361/225

(56) References Cited

U.S. PATENT DOCUMENTS 6,532,347 B2 3/2003 Watanabe et al. ..... 399/50
2003/0219268 A1 * 11/2003 Sunahara et al. ..... 399/50

FOREIGN PATENT DOCUMENTS

JP 2001-201921 7/2001

* cited by examiner

*Primary Examiner*—Quana Grainger
(74) *Attorney, Agent, or Firm*—Fitzpatrick, Cella, Harper & Scinto

(57) ABSTRACT

An image forming system that can prevent the image carrier from wearing because of excessive discharge, even under property fluctuations in the charging unit and surrounding conditions, and can maintain stable, excellent image quality for a long time. The system lowers fluctuations in current detection by making the characteristic of the AC charge current detection circuit variable and switching the AC charge current detecting characteristics between the voltages lower than discharge threshold voltage and the voltages higher than that.

13 Claims, 13 Drawing Sheets

IMAGE FORMING SYSTEM AND IMAGE FORMING METHOD FOR DECIDING AC VOLTAGE TO BE APPLIED TO CHARGER

This application claims priority from Japanese Patent Application No. 2002-207551 filed Jul. 16, 2002, which is incorporated hereinto by reference.

BACKGROUND OF THE INVENTION

1. Field of the Invention

The present invention relates to an image forming system and an image forming method that can conduct a charging control for the image carrier.

2. Description of the Related Art

In many conventional image forming systems like electrophotographic devices and electrostatic recording devices, the non-contact type corona charging method is usually employed to charge the surface of the image carrier made of, for example, photosensitive material and dielectric material. According to this charging method, corona produced by loading high voltage onto a thin corona discharging wire is provided to the surface of the image carrier for charging.

In recent years, however, because of advantages of low ozone-emission and low cost, such a contact type charging method has become popular that charges the image carrier by applying voltage to a roller or blade type charging unit and then containing it to the surface of the image carrier.

Particularly, the roller type charging unit shows stable charging performance over a long time. Although the charging unit can work with DC voltage alone, it is charged uniformly if AC voltage is used to repeat plus and minus discharging alternatively. For example, a DC voltage(DC offset bias) is overlapped with an AC voltage that has an inter-peak voltage higher than the charging unit's discharge threshold(discharge initiating DC voltage). It is known that such voltage vibrations make charges on the charging unit uniform. The waveforms of voltage vibration may be sinusoidal, rectangular, triangular or pulse-like. Voltage vibrations include the rectangular voltage waves generated by turning on/off DC voltage at regular intervals and overlap of AC voltage and DC voltage where the level of DC voltage is periodically modulated.

The contact type charging method that charges a charging unit by applying such voltage vibrations thereto is referred to as the AC charging method here. On the other hand, the contact type charging method using only DC voltage for charging is referred to as the DC charging method. Compared with the DC charging method, the AC charging method provides more charges to the image carrier and thus the degradation of the image carrier, for example, wear is accelerated. In addition, it occasionally poses problems such as image escape due to charge products under high-temperature, high-humidity conditions.

To solve such problems, the applied voltage and the alternative (plus and minus) discharge must be minimized. In reality, however, the amount of discharge is not fixed only by the applied voltage but changes with various factors such as the film thickness of the photosensitive layer or dielectric layer of the image carrier and conditions of the charging unit and ambient air. Under low temperature, low humidity (L/L) conditions, the charging material is dried and its resistivity rises, making discharge harder to occur. Thus the inter-peak voltage must be higher than a certain level for uniform charging. Meanwhile, during charging under high temperature, high humidity (H/H) conditions, the charging material gets damp and its resistivity decreases. As a result, under H/H conditions, the charging unit produces more charges than necessary even at the minimum voltage applied for uniform charging under L/L conditions. Then the amount of charge increases and such problems arise that image quality is impaired, fused toner adheres and the image carrier lasts shorter because of surface wear.

In addition to variations in the surrounding conditions, fluctuations in the manufactured charging unit, resistivity variations due to stains, changes in the capacitance of the image carrier over time and performance fluctuations in the high voltage supply device lead to fluctuations in the amount of charge. As a technique to reduce fluctuations in the amount of charge, Japanese Patent Application Laid-open No. 2001-201921 has disclosed a discharge current control method. In this method, the AC voltage applied to the charging unit is variable in the image forming system. Specifically, the individual AC currents at two or more voltages, some of which are lower than the discharge threshold and others higher than that, are detected, and such AC voltage is calculated that provides the best amount of charge based on the detected AC currents, in order to determine the AC voltage to be loaded to the charging unit.

The above charging current control method, however, has the following problem. When there are detection errors during current detection, it is difficult to precisely measure AC current at a voltage lower than the discharge threshold voltage and AC current at a voltage higher than the discharge threshold voltage, and therefore the charge voltage level providing the best charging is not calculated.

Current detection accuracy can be raised by narrowing the range of current detection.

However, it is difficult to narrow the detection range because of a large gap between the current at a voltage lower than the discharge threshold voltage and the current at a voltage higher than the discharge threshold voltage, and eventually the detection accuracy decreases.

In this invention, current detection accuracy is improved by switching the detection ranges of AC current for charging between voltages lower than the discharge threshold and voltages higher than the threshold and by detecting current in the individual optimized (narrow) detection ranges. Then fluctuations in the detected current become small. As a result, problems such as degradation of the image carrier caused by excessive charging produced by performance fluctuations of the charging unit and ambient conditions can be prevented. An object of the invention is therefore to provide an image forming system and an image forming method that can maintain high image quality over a long time by preventing such problems.

SUMMARY OF THE INVENTION

To accomplish such an object, the present invention provides an electrophotographic image forming system for forming an electrostatic latent image by applying AC voltage to a charger contacting an image carrier and thereby charging the surface of the image carrier. This system comprises a detector that detects AC charge current by applying a particular AC voltage to the charger, a detection characteristic switching unit that switches current detection characteristics between the non-discharge region and discharge region when detecting AC charge current, a detector that measures AC charge current in either the switched non-discharge region or discharge region, an AC voltage decision unit that decides AC charge voltage to be applied to the charger during image formation based on the measured AC charge current, and a load control unit that controls the decided AC charge voltage to be applied to the charger during image formation.

The invention provides another electrophotographic image forming system for forming an electrostatic latent image by applying AC voltage to a charger contacting an image carrier and thereby charging the surface of the image carrier. This system comprises a first detector that detects AC charge current by applying a particular AC voltage to the charger, a second detector that has a current detection characteristic different from that of the first detector and detects AC charge current running in the charger, an AC current detector switching unit that switches the first detector and the second detector between the non-discharge region and discharge region when detecting AC charge current, a detector that measures AC charge current in either the switched non-discharge region or discharge region, an AC voltage decision unit that decides an AC charge voltage to be applied to the charger during image formation based on the measured AC charge current, and a load control unit that controls the decided AC charge voltage to be applied to the charger during image formation.

The invention provides an electrophotographic image forming method of forming an electrostatic latent image by applying AC voltage to a charger contacting an image carrier and thereby charging the surface of the image carrier, comprising the steps of detecting AC charge current by applying a particular AC voltage to the charger, switching the current detection characteristics between the non-discharge region and discharge region when detecting AC charge current, measuring AC charge current in either the switched non-discharge region or discharge region, deciding AC charge voltage to be applied to the charger during image formation based on the measured AC charge current, and controlling the decided AC charge voltage to be applied to the charger during image formation.

The invention provides another electrophotographic image forming method of forming an electrostatic latent image by applying AC voltage to a charger contacting an image carrier and thereby charging the surface of the image carrier, comprising a first detection step of detecting AC charge current by applying a particular AC voltage to the charger, a second detection step of detecting AC charge current running in the charger by a current detection characteristic different from that of the first detection step, a step of switching the first detector and the second detector between the non-discharge region and discharge region when detecting AC charge current, a step of measuring AC charge current in either the switched non-discharge region or discharge region, a step of deciding an AC charge voltage to be applied to the charger during image formation based on the measured AC current, and a control step of controlling the decided AC charge voltage to be applied to the charger during image formation.

The invention provides a program product that includes an electrophotographic image forming program that forms an electrostatic latent image by applying AC voltage to a charger contacting an image carrier and thereby charging the surface of the image carrier. The program, which is stored in a recording medium readable by computers, comprises the steps of detecting AC charge current by applying a particular AC voltage to the charger, switching the current detection characteristics between the non-discharge region and discharge region when detecting AC charge current, measuring AC charge current in either the switched non-discharge region or discharge region, deciding AC charge voltage to be applied to the charger during image formation based on the measured AC charge current, and controlling the decided AC charge voltage to be applied to the charger during image formation.

The invention provides another program product that includes an electrophotographic image forming program that forms an electrostatic latent image by applying AC voltage to a charger contacting an image carrier and thereby charging the surface of the image carrier. The program, which is stored in a recording medium readable by computers, comprises, a first detection step of detecting AC charge current by applying a particular AC voltage to the charger, a second detection step of detecting AC charge current running in the charger by a current detection characteristic different from that of the first detection step, a step of switching the first detector and the second detector between the non-discharge region and discharge region when detecting AC charge current, a step of measuring AC charge current in either the switched non-discharge region or discharge region, a step of deciding an AC charge voltage to be applied to the charger during image formation based on the measured AC current, and a control step of controlling the decided AC charge voltage to be applied to the charger during image formation.

The invention provides a storage medium for storing a computer program for controlling electrophotographic image formation that forms an electrostatic latent image by applying AC voltage to a charger contacting an image carrier and thereby charging the surface of the image carrier. The program causes a computer to detect AC charge current by applying a particular AC voltage to the charger, switch current detection characteristics between the non-discharge region and discharge region when detecting AC charge current, measure AC charge current in either the switched non-discharge region or discharge region, decide AC charge voltage to be applied to the charger during image formation based on the measured AC charge current, and control the decided AC charge voltage to be applied to the charger during image formation.

The invention provides another storage medium for storing a computer program for controlling electrophotographic image formation that forms an electrostatic latent image by applying AC voltage to a charger contacting an image carrier and thereby charging the surface of the image carrier. The program causes a computer to apply a particular AC voltage to the charger to detect AC charge current, detect the AC charge current running in the charger under a different detection characteristic, select either of the two detection characteristics between the non-discharge region and discharge region when detecting AC charge current, measure AC charge current in either the selected non-discharge region or discharge region, decide AC charge voltage to be applied to the charger during image formation based on the measured AC charge current, and control the decided AC charge voltage to be applied to the charger during image formation.

In addition to the above constitutions, the present invention may adapt the following functions.

The current detection characteristic may be switched between the case where an AC voltage no higher than a discharge threshold voltage is applied and the case where an AC voltage no lower than the discharge threshold voltage is applied.

The first and second detection steps may be switched between the case where an AC voltage no more than a discharge threshold voltage is applied and the case where an AC voltage no lower than the discharge threshold voltage is applied.

With the discharge threshold voltage being the voltage for initiating discharge to the image carrier when DC voltage is applied to the charger, the current running when at least one AC voltage no more than Vt is applied to the charger and the current running when at least two AC voltages no lower than the discharge threshold voltage are applied thereto may be detected during non-image formation.

The mean value of the half-wave current of the AC charge current may be detected when the AC charge current is detected.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now the present invention is described along with specific examples.

First Embodiment

A first embodiment of the invention is explained with reference to FIGS. 1–8.

(System Structure)

Figure 1:
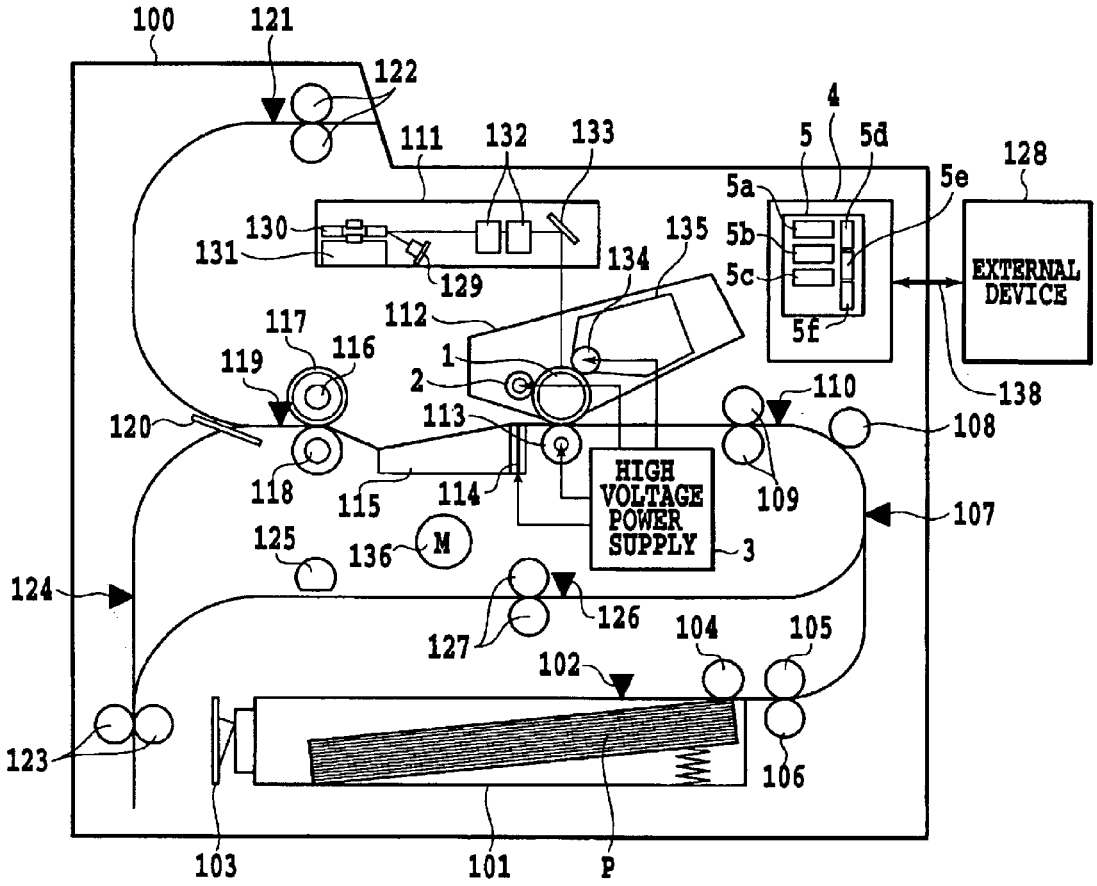
FIG. 1 is a vertical sectional view of the image forming system of a first embodiment of the invention illustrating its structure.

FIG. 1 is an example of the structure of a laser printer 100 that belongs to the image forming system of the present invention.

The laser printer 100 has a deck 101 holding recording paper P. The deck 101 has a deck sensor 102 that detects the presence/absence of recording paper p, a paper size sensor 103 that detects the size of recording paper p, and a pickup roller 104 that picks up recording paper P. The laser printer 100 further comprises a deck paper transport roller 105 that transports recording paper P picked up by the pickup roller 104 and a retard roller 106 that works with the deck paper transport roller 105 to prevent recording paper P from being stacked during transport.

In the downstream of the deck paper transport roller 105 installed are a feeder sensor 107 that detects the state of paper sent from the deck 101 and a turn-over unit for double-sided printing(to be described later), a paper transport roller 108 that transports recording paper P to further downstream, a pair of resist rollers 109 that transport recording paper P in synchronization, and a pre-resist sensor 110 that detects the transport state of recording paper P that has reached the pair of resist rollers 109.

In the downstream of the resist roller pair 109 installed are a process cartridge 112 that forms toner images on the photosensitive drum 1 using laser light from a laser scanner unit 111(to be described later), a roller unit 113(image transfer roller) that transfers the toner image formed on the photosensitive drum 1 onto recording paper P, and a discharging unit 114(discharge wire) that removes charges on recording paper P and helps it leave from the photosensitive drum 1.

In the downstream of the discharge wire 114 installed are a transport guide 115, a pair of a pressure roller 118 and a fuser roller 117 equipped with a halogen heater 116 therein that fuses the toner image transferred onto recording paper P, a fuser exit sensor 119 that detects the state of paper transported from the fuser unit, and a flapper 120 that switches the ways of recording paper P sent from the fuser unit to either the exit unit or the turn-over unit. In the downstream on the paper output side, an exit sensor 121 that detects the state of paper sent to the paper output unit and a pair of ejection rollers 122 that eject printed recording paper.

Meanwhile, in the turn-over unit that turns over recording paper P of which either side has been printed and sends it to the image formation unit for printing on the other side for double-sided printing, installed are a pair of reverse rollers 123 that switch back recording paper P by forward/reverse rotations, a reverse sensor 124 that detects the state of paper sent to the reverse rollers, a D-cut roller 125 that transports recording paper P from a transverse resist unit(not shown) that aligns recording paper P in the transverse direction, a sensor 126 in the turn-over unit that detects the state of recording paper P in the turn-over unit, and a pair of transport rollers 127 in the turn-over unit that transport recording paper P from the turn-over unit to the feeder unit.

The scanner unit 111 has a laser unit 129 that emits laser light modulated by image signals sent from an external device 128(to be described later), a polygon mirror 130 that scans later light provided by the laser unit 129 on the photosensitive drum 1, an image formation lens assembly 132 and a return mirror 133.

The process cartridge 112 has a photosensitive drum 1 needed for common electrophotography, a charging roller 2 and development roller 134 that work as the charging unit, and a toner container 135. The process cartridge 112 is configured to be detachable from the laser printer 100.

The printer has a high voltage circuit for charging(to be described later), a high voltage power supply 3, a development roller 134, a transfer roller 113 and a high voltage circuit that supplies a desired voltage to the discharge wire 114. The main motor 136 supplies driving power to individual units.

The printer controller 4 that controls the laser printer 100 has CPU(micro computer) 5 equipped with RAM 5*a*, ROM 5*b*, a timer 5*c*, a digital input/output port(hereinafter, I/O port) 5*d*, an analog-digital converter input port(hereinafter, A/D port) 5*e* and a digital-analog output port(hereinafter, D/A port) 5*f*, as well as input-output control circuits(not shown). The printer controller 4 is connected to an external device 128 such as a personal computer via an interface 138.

(Structure of the Charging Output Control Circuit)

Figure 2:
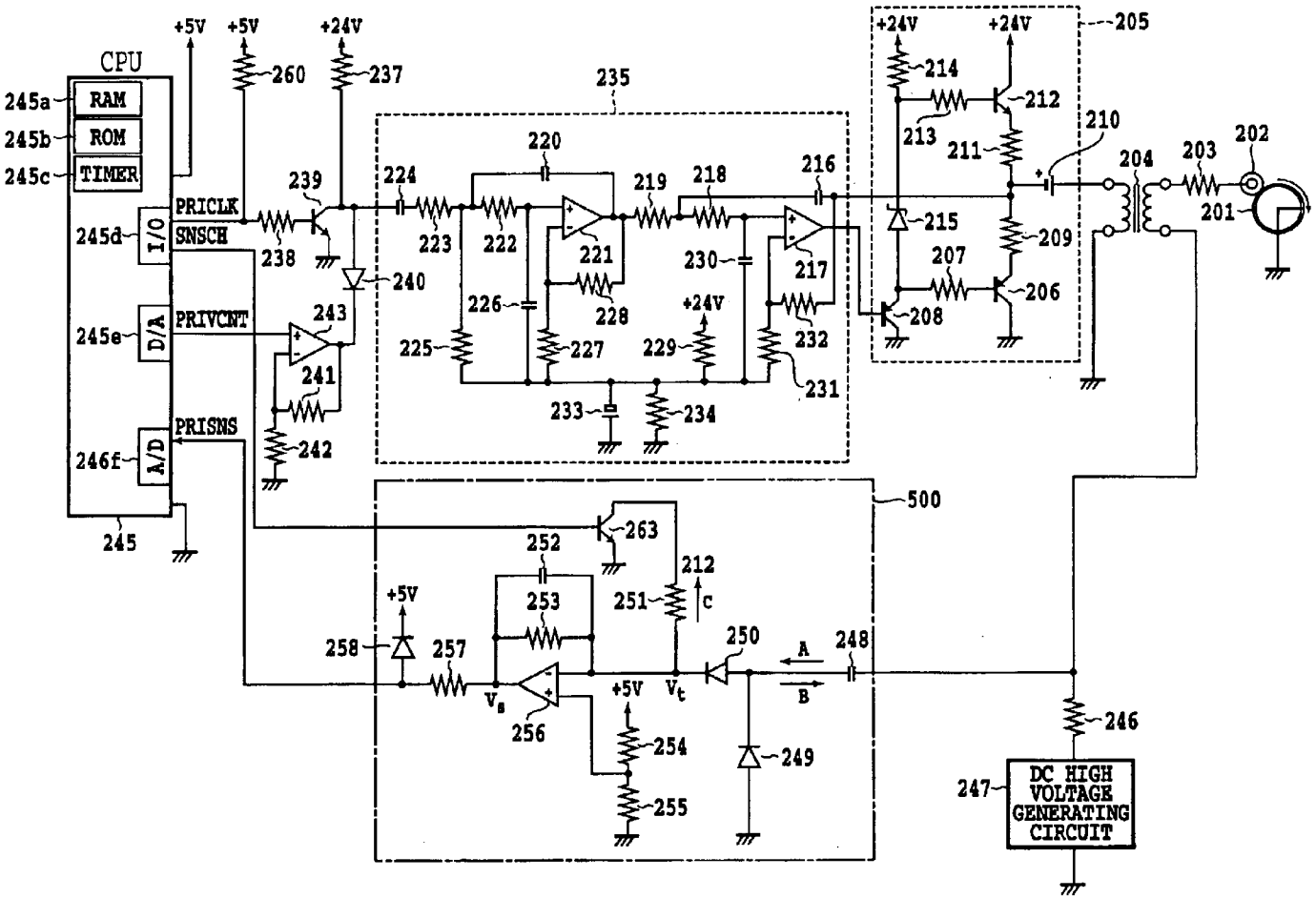
FIG. 2 is a circuit diagram of the charge output control circuit including the current detection circuit.

FIG. 2 is an example of the structure of the charging output control circuit of the invention.

The charging output control circuit can be roughly divided into an AC current detection unit, a detection characteristic switching unit, an AC current measurement unit, an AC voltage decision unit, and a load control unit.

The current detection circuit 500 includes the AC current detection unit, the detection characteristic switching unit and the AC current measurement unit. The AC voltage decision unit and the load control unit are controlled by software such as control programs (to be explained later) that runs in CPU 245.

Now the function of each unit is explained below.

The AC current detection unit detects AC charge current by applying a prescribed level of AC voltage to the charging unit.

The detection characteristic switching unit switches the current detection characteristics corresponding to the non-discharge region and the discharge region when detecting AC charge current. Specifically, the current detection characteristic are changed between the time when an AC voltage lower than discharge threshold voltage is loaded and the time when AC voltage higher than the discharge threshold voltage is loaded.

The AC current measurement unit measures AC current in the switched non-discharge region or discharge region.

The AC voltage decision unit decides AC charge voltage that will be loaded to the charging unit during image formation, based on the measured AC current.

The load voltage control unit controls the decided AC charge voltage so as to be loaded to the charging unit.

Now the specific functions of the charging output control circuit including the current detection circuit 500 of FIG. 2 are described below.

The charging output control circuit produces high voltage for charging where AC high voltage is overlapped with DC high voltage, and applies this charging voltage to the charging roller 202 that contacts the photosensitive drum 201. The output level of AC high voltage is controlled by the level control signal(PRIVCNT) sent from CPU 245 in the printer controller 4. When clock pulses(PRICLK) are provided from the I/O port 245D of CPU 245, a transistor 239 switches via a pull-up resistor 260 and a base resistor 238. Next, clock pulses are amplified to have an amplitude corresponding to the output from an operation amp 243 connected thereto via a pull-up resistor 237 and a diode 240. If this amplitude is large, the amplitude of sinusoidal driver voltage waves provided to a high voltage transformer 204(to be described later) also becomes large, and the AC high voltage grows as well.

To the positive output of the operation amp 243, analog signals(PRIVCNT) sent from the D/A port of CPU 245*c* is provided. Then signals of a level corresponding to the PRIVCNT signal are provided to the output of the operation amp 243. The AC high voltage level is thereby controlled by the PRIVCNT signal. Clock pulses are provided via a capacitor 224 to a filter circuit 235 that is a 4-rank Butterworth type filter composed of resistors 223–232, capacitors 216–220 and operation amps 217, 221. The filter circuit 235 accompanying an electrolytic capacitor 233 provides sinusoidal waves across +12V.

Next, the output from the filter circuit 235 is provided to the primary coil of a high-voltage transformer 204 via a push-pull type high voltage transformer driver circuit 205, and sinusoidal waves of AC high voltage are produced in the primary coil. When a terminal of the secondary coil of the high-voltage transformer is connected to a DC high-voltage generating circuit 247 via a resistor 246, high voltage where AC high voltage is added to DC high voltage is supplied to the charging roller 202 via an output protection resistor 203.

(Current Detection Circuit)

Next the functions of the current detection circuit 500 is explained below.

Ac current generated by the above charging output control circuit runs in the capacitor 248, and the half-wave current in direction A runs in the diode 250, while the half-wave current in direction B runs in the diode 249. The half-wave currents in direction A that have passed the diode 250 come in an integral circuit composed of an operation amp 256, a resistor 253 and a capacitor 252 to be transformed into DC voltage Vs.

A resistor 251 is connected to the input of the integral circuit, and current Ic runs in direction C. Current Ic is controlled by SNSCH signal sent from CPU 245, and when the SNSCH signal is switched to the HIGH state, the transistor 263 turns On and current Ic runs. When the SNSCH signal is in the LOW state, the transistor 263 turns Off and current Ic does not run. The output voltage Vs of the operation amp 256 is expressed by:

$$Vs=-(Rs\times I\text{mean})+Vt \quad (1)$$

$$Vs=-(Rs\times I\text{mean})+Vt\times(Rs/Rc+1) \quad (2)$$

where Imeans is the mean of half waves of AC current, Rs the resistance of the resistor 253, Rc the resistance of the resistor 251 and Vt the voltage supplied to the positive input of the operation amp 256. Equation (1) expresses the characteristics seen when the SNSCH signal is in the LOW state, while Equation (2) expresses the characteristic seen when the SNSCH signal is in the HIGH state. The voltage of the output terminal of the operation amp 256 is supplied to the A/D port of CPU 245 as the current detection signal PRISNS, and converted into a digital signal in CPU 245.

Figure 3:
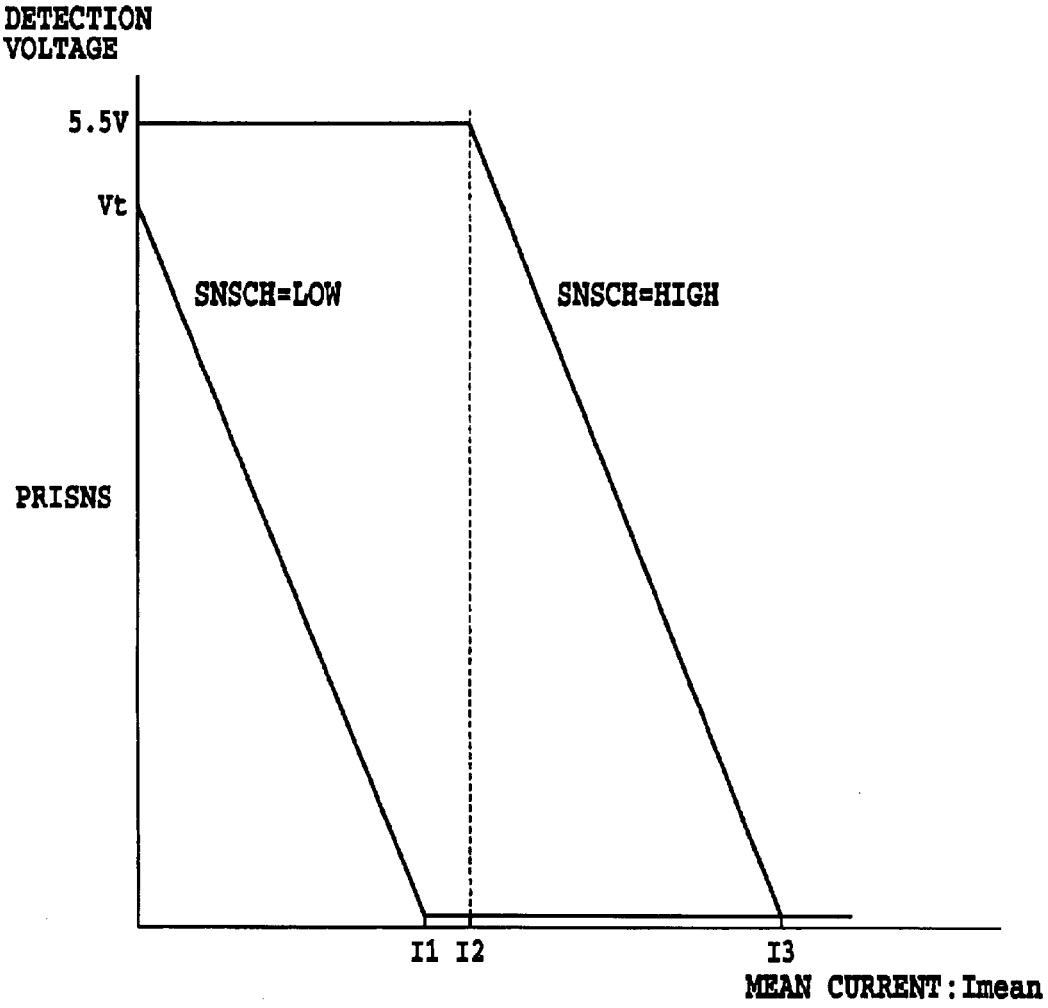
FIG. 3 is a schematic diagram illustrating the detection characteristics of the current detection circuit.

FIG. 3 shows the characteristics of current detection signal PRISNS observed when the SNSCH signal is in the HIGH state or LOW state. The level of detection voltage PRISNS signal varies in the 0–I1 range of mean current Imean when the SNSNH signal is in the LOW state, while varies in the I2–I3 range when the SNSCH signal is in the HIGH state. Namely, the detection ranges are switched according to the SNSCH signal.

(Charging High Voltage Output Control)

Next explained is the output control of charging high voltage conducted during print operation in the image forming system.

Figure 4:
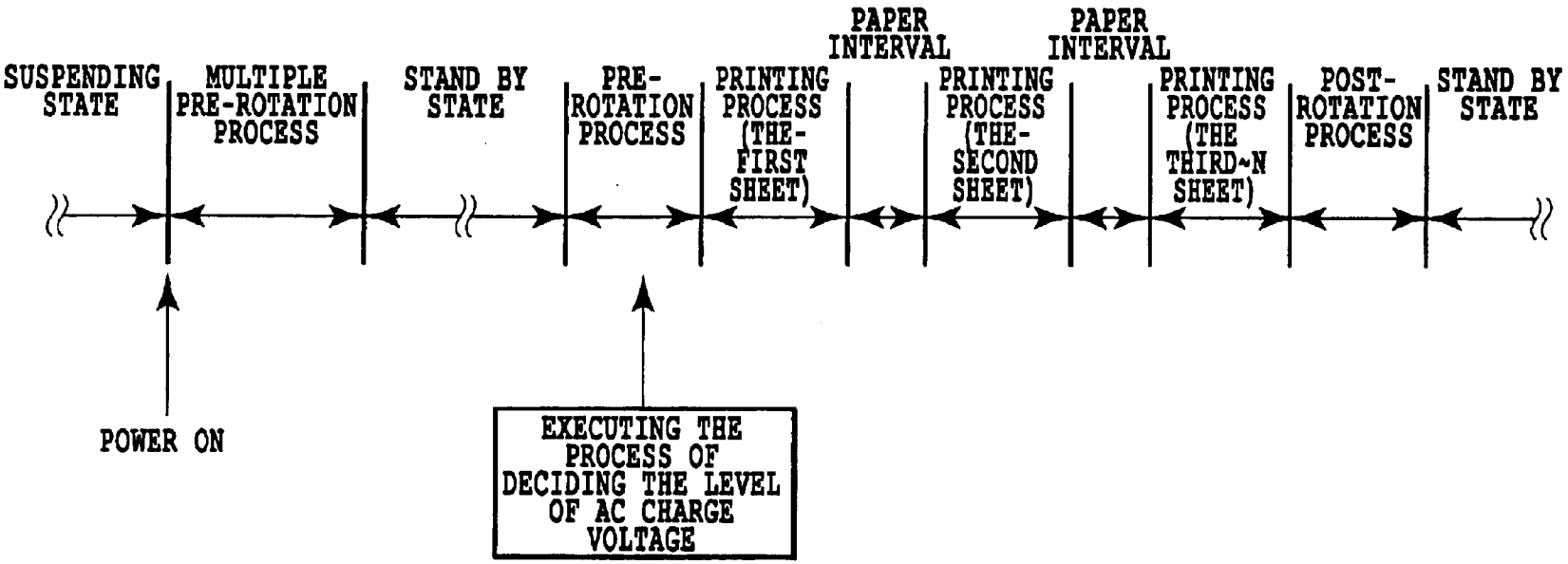
FIG. 4 is a block diagram illustrating the print sequence of the invention.

FIG. 4 shows a sequence of printing operation in the image forming system of the invention.

When the system 100 is power On, it activates the fuser unit (fuser roller 117) and comes into a standby state after executing multiple pre-rotation process for a series of steps of raising the temperature of the fuser unit to a particular temperature.

Next, when it receives a print start command from the external device 128 such as a personal computer, it carries out the pre-rotation process as particular preparations for printing, and starts printing on recording paper based on a series of electrophotographic steps.

When plural paper sheets are printed, the second sheet is printed after a predetermined process has been performed during the paper interval until printing on the next paper. After printing on the last sheet of paper, the post-rotation process is executed and the system returns to the standby state again.

In the image forming system of this embodiment, the process of deciding the level of AC charge voltage for printing is carried out during the pre-rotation period, and the AC high voltage for charging during printing is controlled by the decided AC voltage level.

Figure 5:
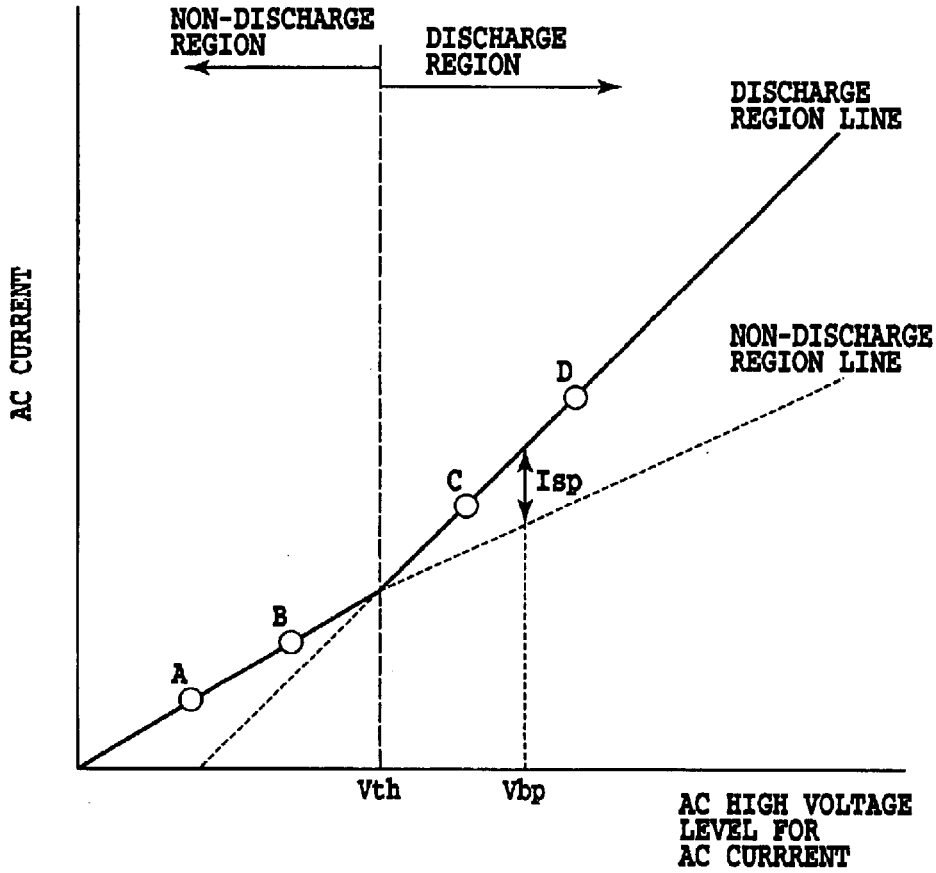
FIG. 5 is a characteristic diagram illustrating the relationship between AC high voltage for charging and charge current.

FIG. 5 is a characteristic diagram illustrating the relationship between the AC high voltage level for charging and AC current.

The AC high voltage threshold, Vth (discharge threshold voltage), is the voltage at which discharge occurs between the charging roller 2 and the photosensitive drum 1.

In the AC voltage region where voltage is lower than the discharge threshold voltage, only a nip current corresponding to the resistance or capacitance between the charging roller 2 and the photosensitive drum 1 runs (hereinafter, this region is referred to as the non-discharge region).

On the other hand, in the AC voltage region where voltage is higher than the discharge threshold voltage, the sum of the nip current and a discharge current due to discharge generated between the nip of the charging roller 2 and the photosensitive drum 1 runs (hereinafter, this region is referred to as the discharge region).

In each region, charging current changes linearly against AC voltage (linear region). Thus in the discharge region, the difference between the characteristic value in the discharge region and that in the non-discharge region becomes the discharge current.

In this embodiment, by loading high voltages for charging at two points A and B in the non-discharge region in FIG. 5 and at two points C and D in the discharge region, the individual AC currents at those points are detected. Then the characteristic values in the non-discharge region and the discharge region are calculated to decide the AC high voltage for charging, Vp, that provides a predetermined discharge current Isp.

Figure 6:
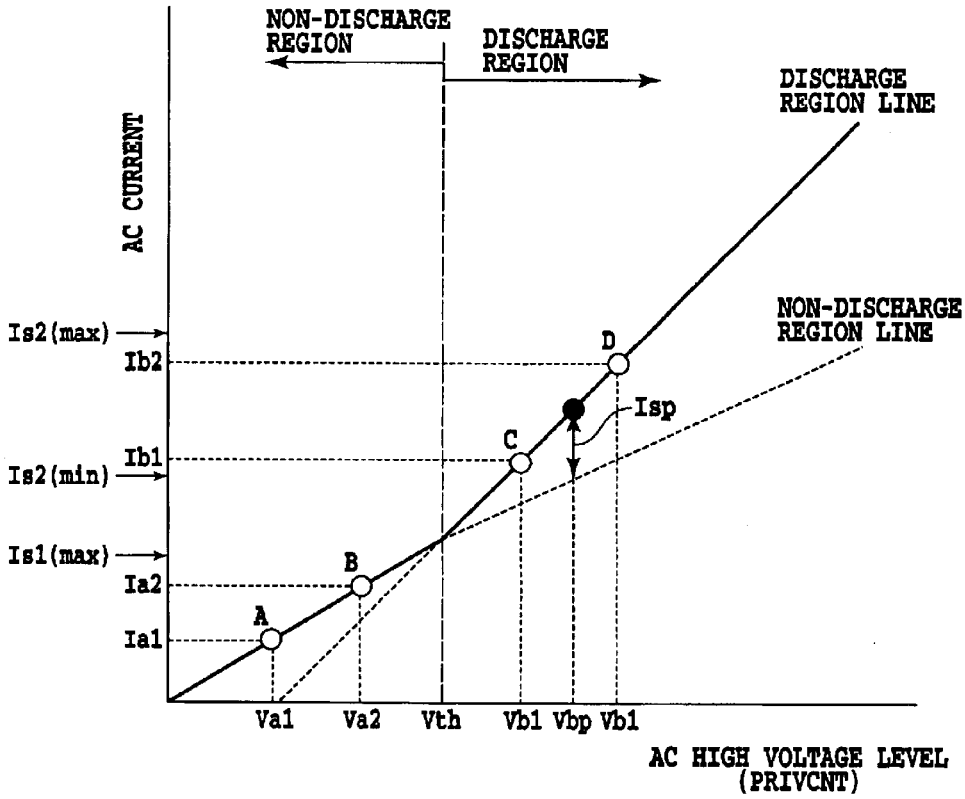
FIG. 6 is a characteristic diagram illustrating the relationship between control signals for AC high voltage for charging and charging current.

FIG. 6 shows the relationship between the PRIVCNT signal, which is the signal for controlling AC high voltage level sent from CPU 245, and charge current.

Because the PRIVCNT signal is proportional to the AC high voltage level, the value of PRIVCNT that provides a predetermined discharge current Isp is calculated by detecting the charge current corresponding to the predetermined PRIVCNT signal in practical control. In the present embodiment, charge currents Ia1 and Ia2 corresponding to PRIVCNT signals Va1 and Va2 are measured.

(Decision Process for the AC High Voltage Level for Charging)

Figure 7:
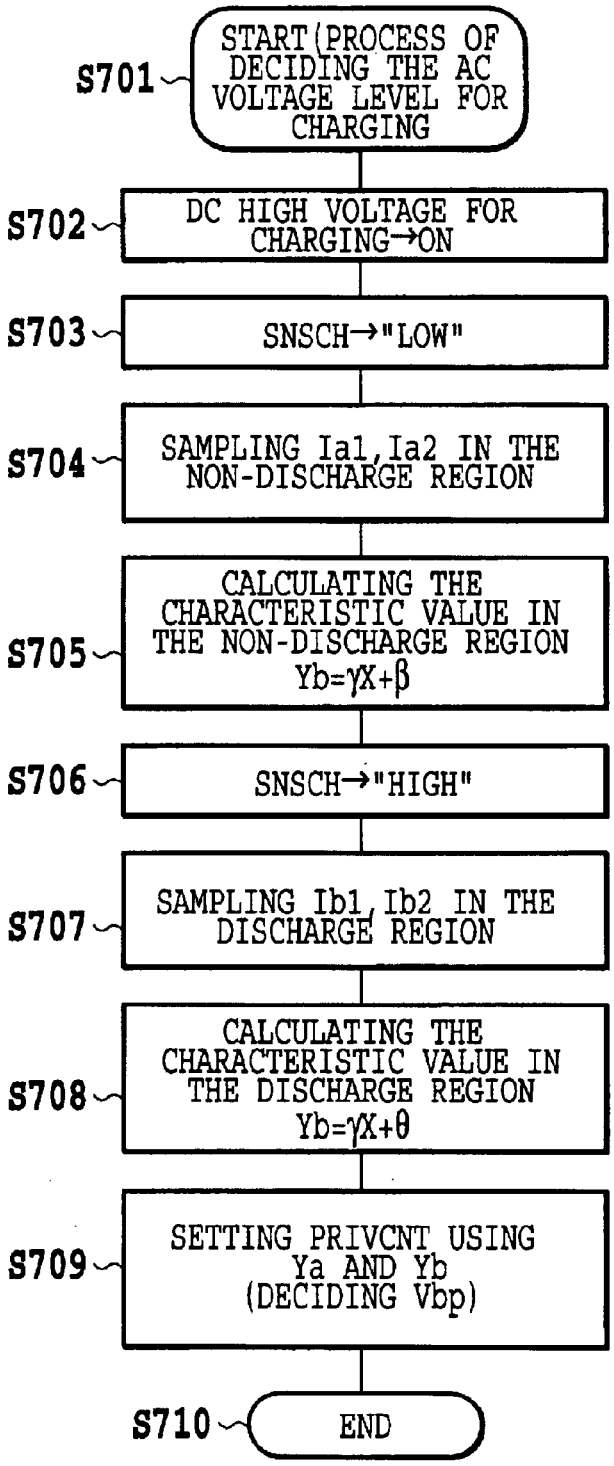
FIG. 7 is a flowchart illustrating the steps of deciding AC high voltage levels for charging.

FIG. 7 is a flowchart illustrating a series of steps for deciding the AC voltage level for charging during printing.

First, at S702, the DC high voltage for charging is turned On, while at S703 the SNSCH signal working as the detection current range switching signal is set to the LOW state.

Figure 8A:
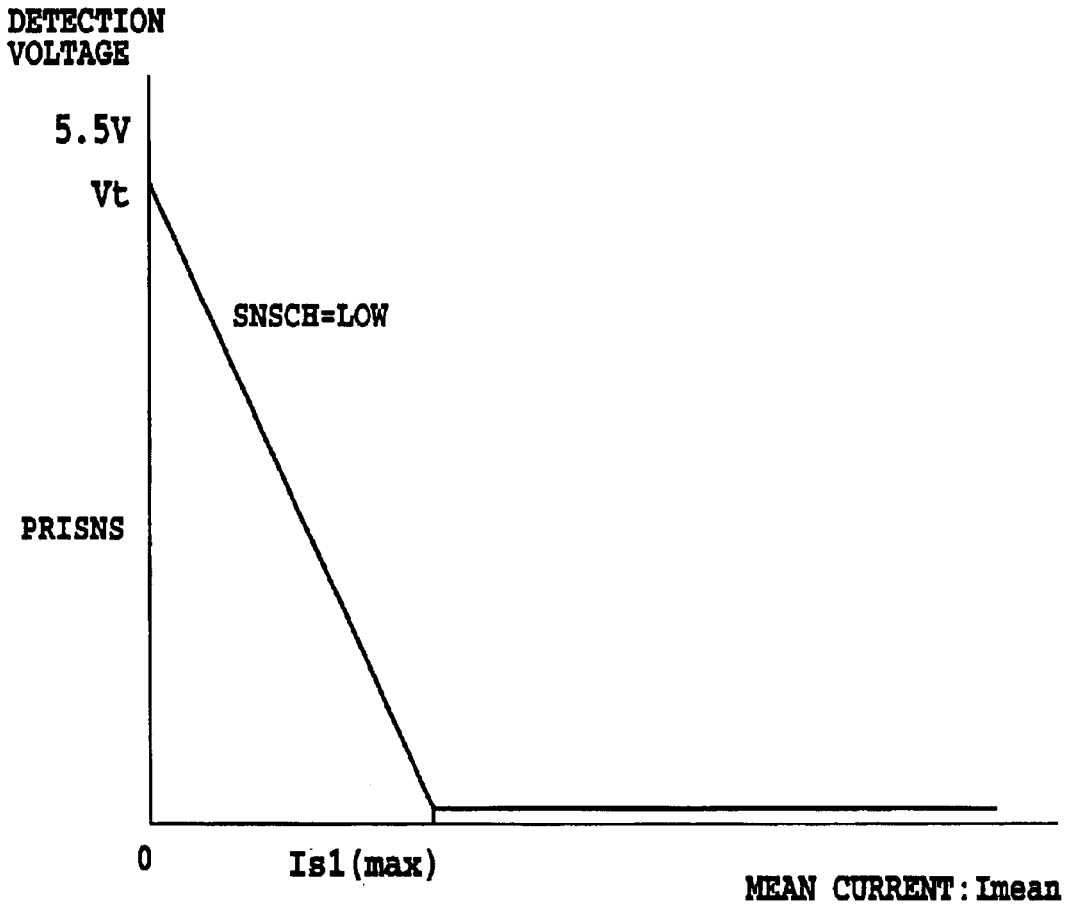
FIG. 8A is a schematic diagram illustrating the detection characteristics of the current detection circuit.

FIG. 8A is a characteristic diagram of detected signals provided when the SNSCII signal is set to the LOW state, which is useful in detecting charge current in the 0–Is1(max) range. As shown in FIG. 6, the 0–Is1(max) range is determined to almost agree with the level of charge current in the non-discharge region.

Next at S703, current is sampled at two points in the non-discharge region.

Now the way of current sampling is explained with reference to FIG. 6 showing the relations between the PRIVCNT signal, which is the signal controlling AC high voltage level sent from CPU 245, and the PRISNS signal that is the charge current detection signal.

First, the PRIVCNT signal is set to Va1 to sample AC charge current Ia2. The sampling is conducted by reading the PRISNS signal, which is the current detection signal, and converting this signal using the conversion table stored in advance in ROM 245*b* of CPU 245.

This sampling is repeated as many as prescribed times and their average is adopted as the final detection value to prevent detection errors caused by fluctuations in the impedance of the charging roller.

Subsequently, the PRIVCNT signal is set to Va2, and current detection value Ia2 is sampled in the same manner as employed in setting Va1.

At S705, the characteristic value in the non-discharge region is calculates from the values of currents Ia1 and Ia2 detected at S704.

The characteristic value is expressed by the following equation:

$$Ya-\alpha\times X+\beta \tag{3}$$

where constant α and β are provided by the following calculations:

$$\alpha=(Va2-Va1)/(Ia2-Ia1) \tag{4}$$

$$\beta=(Ia2\times Va1-Ia1\times Va2)/(Va1-Va2) \tag{5}$$

Next at S706–S708, current is sampled at two points in the discharge region.

First at S706, the SNSCH signal which is the current detection range switching signal is set to the HIGH state.

Figure 8B:
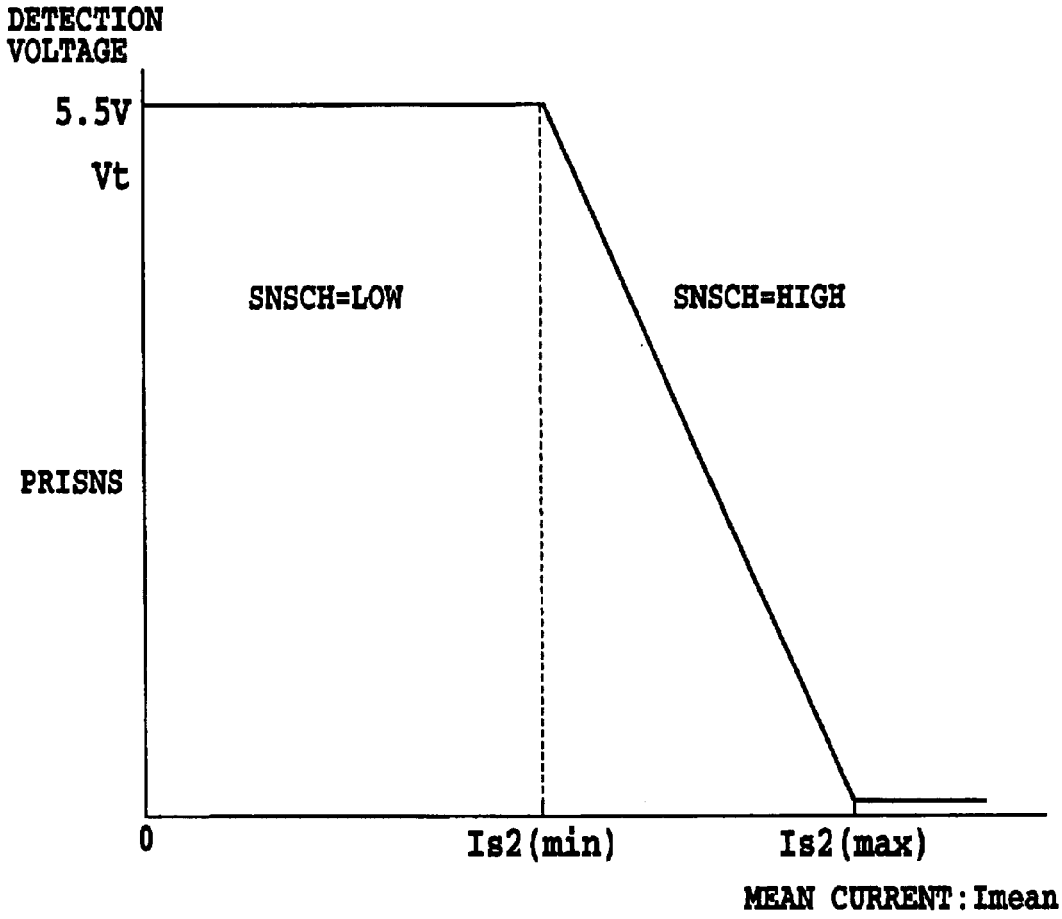
FIG. 8B is a schematic diagram illustrating the detection characteristics of the current detection circuit.

FIG. 8B is a characteristic diagram of detection signals provided when the SNSCH signal is in the HIGH state, and the detectable current lies in the Is2(min)–Is2(max) range.

As shown in FIG. 6, the charge currents in the Is2(min) –Is2(max) range fall in the discharge region.

At S707, charge currents Ib1 and Ib2 are sampled by the same method as employed in sampling in the non-discharge region, for individual cases where the PRIVCNT signal are Vb1 and Vb2.

At S709, the characteristic value in the discharge region is calculated by the following equation:

$$Yb=\gamma\times X+\theta \tag{6}$$

where constants γ and θ are calculated by the following equations:

$$\gamma=(Vb2-Vb1)/(Ib2-Ib1) \tag{7}$$

$$\theta=(Ib2\times Vb1-Ib1\times Vb2)/(Vb1-Vb2) \tag{8}$$

Then the step proceeds to S709, and the high voltage for charging during printing is calculated.

The value of control signal PRIVCNT is decided by Eq. (3) of the characteristic value calculated by the above method in the non-discharge region and by Eq. (6) in the discharge region, through calculation of a charge voltage control signal PRIVCNT that makes the discharge current, which is the difference between the two characteristic values, equal to a predetermined value.

When the discharge current is controlled to be Isp, a voltage X must meet the following requirements:

$$Isp=Yb-Ya=(\alpha\times X+\beta)-(\gamma\times X+\theta) \tag{9}$$

The charge voltage control signal PRIVNCT during printing is decided so that the value of this X becomes equal to Vbp. Next, the setting of PRIVCNT is switched to this Vbp, and then the printing process is started.

As described above, the image forming system of the embodiment is configured to be able to change the detection characteristics of the charge current detection unit. Thus when the AC charge current is detected by applying a predetermined AC high voltage for charging in the pre-rotation process, the detection characteristics of the current detection unit are switched between the non-discharge region and the discharge region, and a precise current detection becomes possible to do.

Based on the detected AC charge currents, an AC charge voltage that will provide a predetermined charge amount is calculated to make the voltage level for printing equal to that decided in the pre-rotation process. Then printing is carried out under a predetermined amount of discharge even when the charging roller characteristics or surrounding conditions fluctuate. As a result, wear of the drum is prevented and drum charging becomes uniform, and thereby the useful life of the photosensitive drum is extended and high image quality is obtained.

Second Embodiment

Now a second embodiment of the invention will be explained with reference to FIGS. 9–11. The same components as those of the first embodiment have the same numbers and their descriptions are not repeated here.

In the above first embodiment, the detection characteristics of detection current have been switched between the non-discharge region and the discharge region when the AC charge current, which is produced by AC high voltage for charging, is measured.

The charging output control circuit of the image forming system of this embodiment has two charge current detection units of different current detection characteristics, and these current detection units are selectively switched between the non-discharge region and the discharge region.

(Structure of the Charging Output Control Circuit)

Figure 9:
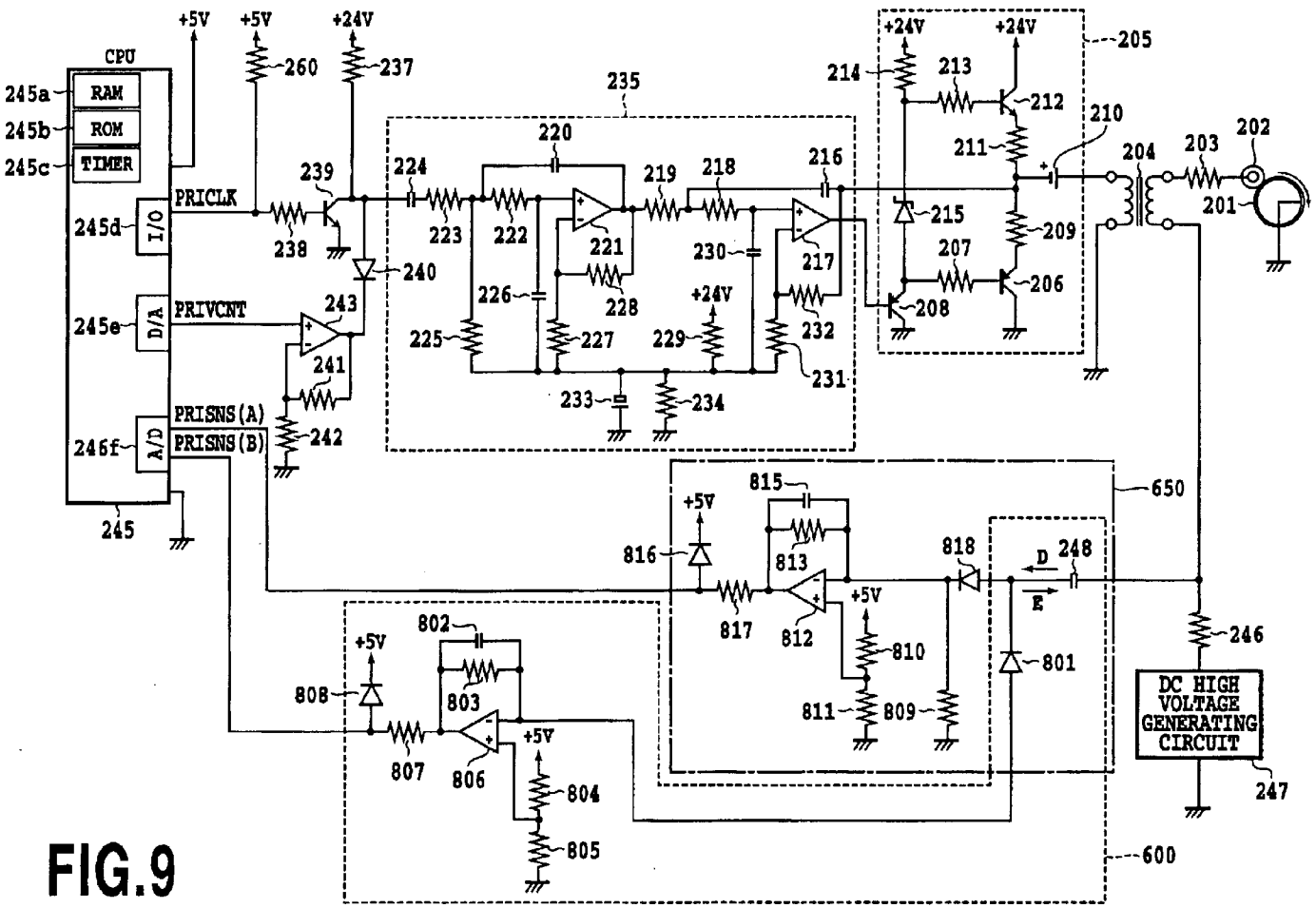
FIG. 9 is a vertical sectional view of the image forming system of a second embodiment of the invention illustrating its structure.

FIG. 9 shows an example of the charge output control circuit of the invention.

The charge output control circuit is roughly divided into a first AC charge current detection unit, a second AC charge current detection unit, an AC current detection switching unit, an AC current measurement unit, an AC voltage decision unit, and a load control unit.

The current detection circuit 600 includes a first AC current detection unit and an AC current measurement unit. The current detection circuit 650 includes a second AC current detection unit and an AC current measurement unit. The AC current detection switching unit, the AC voltage decision unit and the load control unit are installed in CPU 245, and they are controlled by a programmable method including a control program(to be described later).

Now the function of each unit is explained below.

The first AC current detection unit detects AC charge current by applying a particular AC voltage to the charging unit.

The second AC current detection unit is the same as the first AC current detection unit in that they detect AC current running in the charging unit, but their current detection characteristics differ from each other.

When detecting AC charge current, the AC current detection switching unit switches the AC current detection units corresponding to the non-discharge region and the discharge region. Namely, when applying an AC voltage lower than discharge threshold voltage, it selects the first AC current detection unit, while it selects the second AC current detection unit when applying an AC voltage higher than the discharge threshold voltage. Thereby the detection units are switched according to the applied voltage.

The AC current measurement unit measures AC charge current using the detection characteristic of the selected non-discharge region or discharge region.

The AC voltage decision unit decides the AC charge voltage to be applied to the charging unit upon image formation, based on the measured AC charge current.

The load control unit controls the decided AC charge voltage to be applied to the charging unit upon image formation.

The basic structure of the charge output control circuit is the same as that of the charge output control circuit employed in the first embodiment, but the structure of the current detection circuit is different.

(Current Detection Circuit)

Now the specific configurations of the current detection circuit 600, 650 will be described below.

The AC charge current that has passed a capacitor 248 is divided by diodes 818, 801 into half-wave currents. The half-wave current in direction D is provided to an integral circuit including an operation amp 812 via a diode 818.

Meanwhile, the half-wave current in direction E is provided to an integral circuit including an operation amp 806, a resistor 803 and a capacitor 802 via a diode 801. In each of the integral circuits, the AC currents are converted to DC voltages, and provided to the A/D port 246*f* of CPU 245 as detected current signals PRISNS(A) and PRISINS(B). The characteristics of the two detected current signals are expressed by:

$$PRISNS(A)=-(Rsa\times I\text{mean})+Vta \tag{10}$$

$$PRISNS(B)=-(Rsb\times I\text{mean})+Vta\times(Rs/Rcb+1) \tag{11}$$

where Imean is the mean value of the half-wave AC current, Rsa the resistance of the resistor 803, Rcb the resistance of the resistor 809, Vta the voltage provided to the positive input of the operation amp 806, and Vtb the voltage provided to the positive input of the operation amp 812.

Figure 10A:
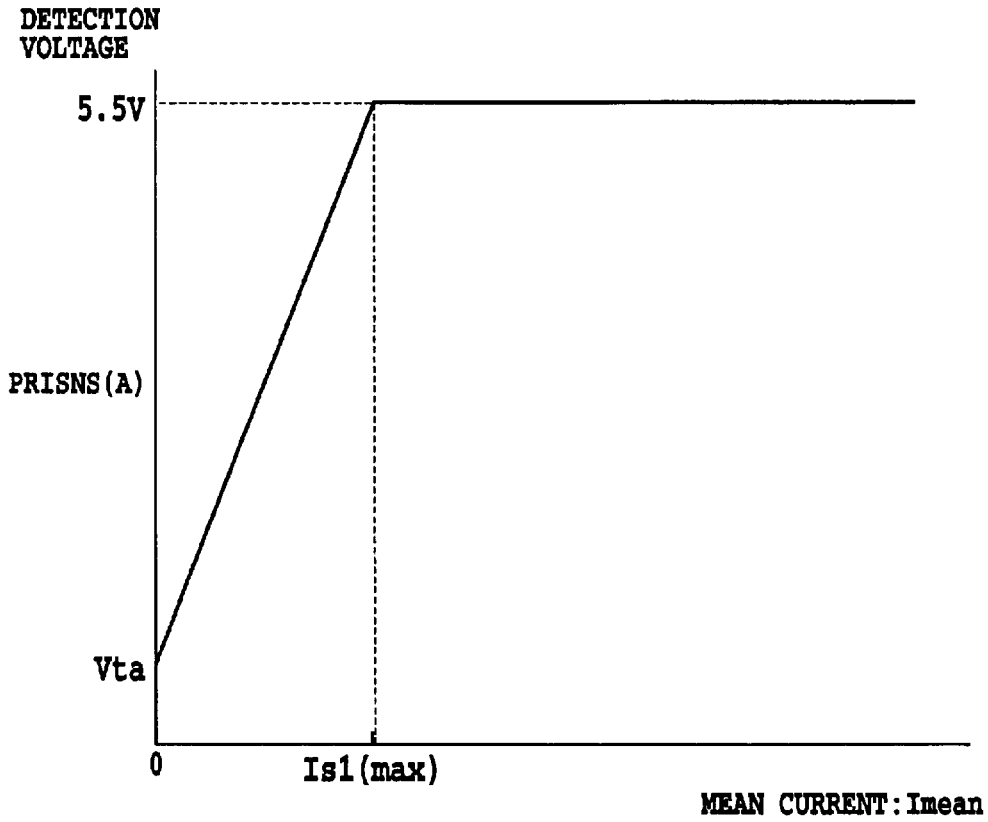
FIG. 10A is a schematic diagram illustrating the detection characteristics of the current detection circuit.
Figure 10B:
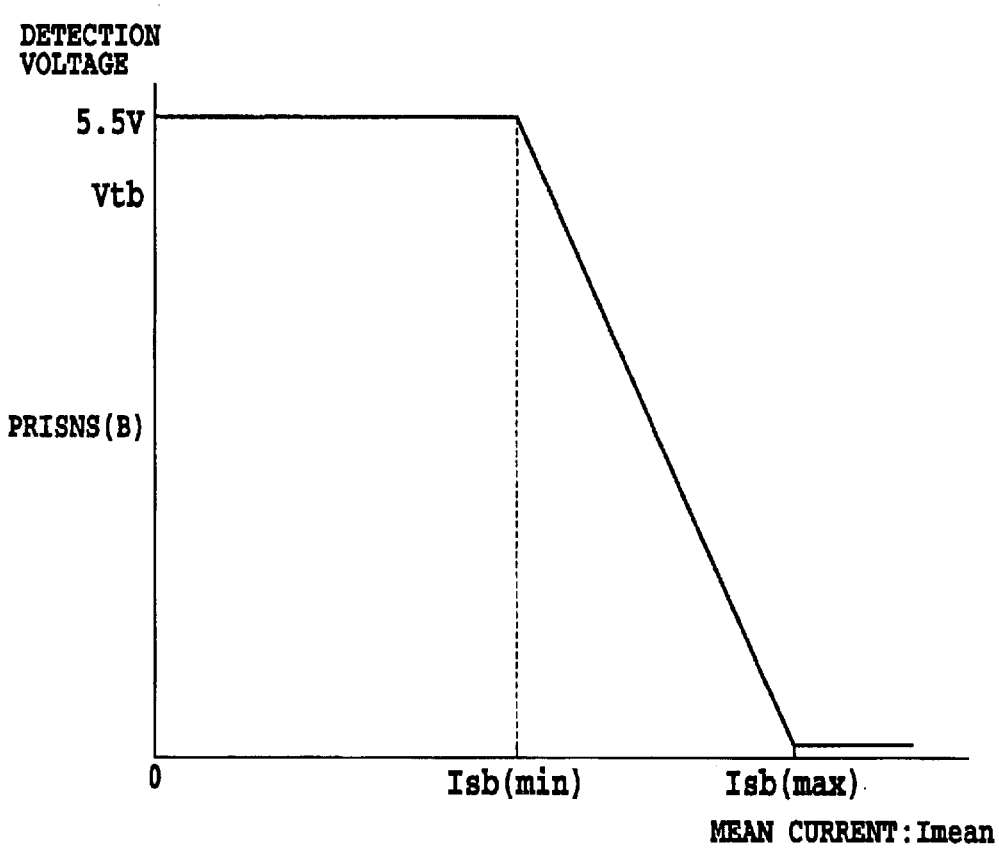
FIG. 10B is a schematic diagram illustrating the detection characteristics of the current detection circuit.

FIGS. 10A and 10B show the characteristic curves of detected current signals PRISNS(A) and PRISINS(B).

During current detection, the PRISNS(A) signal can take a value in the 0–Isa(max) range of charge current Imean in the non-discharge region, while PRISNS(B) signal can take a value in the Isb(min)–Isb(max) range in the discharge region.

(Deciding the Level of AC High Voltage for Charging)

Figure 11:
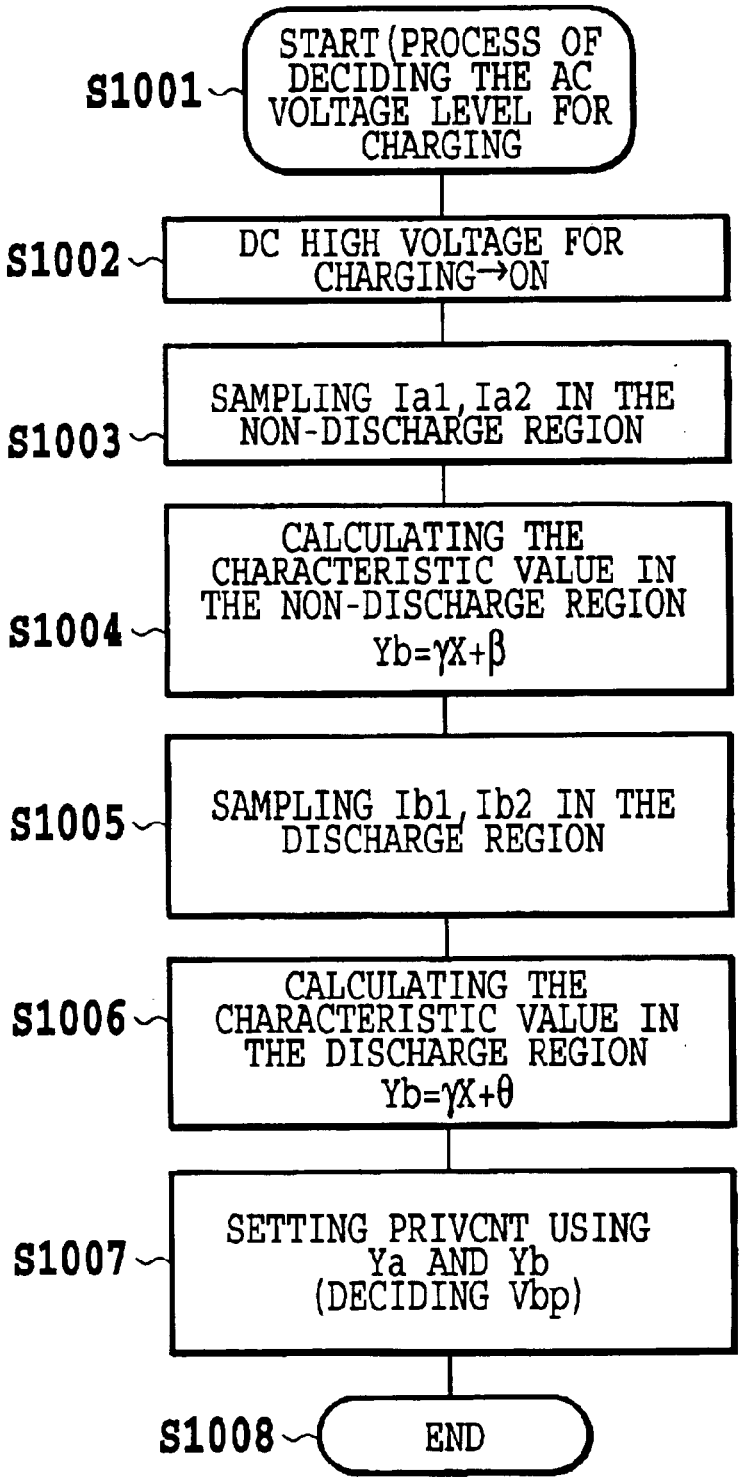
FIG. 11 is a flowchart illustrating the steps of deciding AC high voltage levels for charging.

FIG. 11 is a flowchart illustrating a series of the steps for deciding the AC high voltage level for charging during printing.

In this embodiment, like the first embodiment, the AC high voltage level for charging that provides a particular discharge current is determined by applying voltages Va1 and Va2 in the non-discharge region in FIG. 6 and Vb1 and Vb2 in the discharge region and thereby detecting individual AC charge currents.

First, at S1002, DC charge voltage is turned on, while at S1003 current is sampled at two points in the non-discharge region.

By sampling current in the form of the current detection signal, PRISNS (A), and converting this into current with reference to a conversion table stored in ROM 245*b* of CPU 245, current Ia1 and Ia2 are detected at the two sampling points.

Subsequently, at S1003, by the same method employed in the first embodiment, the characteristic value in the non-discharge region is calculated from the currents, Ia1 and Ia2, detected at S1002.

In a similar manner, at S1005 and S1006, the characteristic value in the discharge region is calculated from currents Ib1 and Ib2 detected at two points in the discharge region by sampling current detection signal PRISNS(B).

Next at S1007, in the same method employed in the first embodiment, the AC high voltage level for charging during printing (charge voltage control signal: PRIVCNT) is decided and then the series of the steps are completed.

As explained above, in the image forming system of this embodiment, it becomes possible to detect current with high precision by preparing two charge current detection units of different characteristics and switching the current detection units selectively between the non-discharge region and the discharge region when detecting the AC charge current by applying a particular AC charge voltage in the pre-rotation process.

The AC high voltage level for charging is calculated to provide a particular amount of discharge based on the detected AC charge current, and the voltage for printing is controlled to be equal to the value decided in the pre-rotation process. Then printing is carried out under a particular amount of discharge even when the charging roller characteristics or surrounding conditions fluctuate. As a result, wear of the drum is prevented and drum charging becomes uniform, and thereby the useful life of the photosensitive drum is extended and high image quality is obtained.

The invention can be used in a system composed of two or more devices (for example, host computer, interface device, reader and printer) as well as a stand-alone system composed of a single device (for example, a compact image processing device like PDA—Personal Digital Assistant, copier and facsimile).

The invention can also achieved by loading a program into a system or device. It is also possible to produce the effect of the invention by installing a memory device storing a program for attaining the goal of the invention in a system or device and then reading and executing the program code stored in such a memory device using a computer (CPU or MPU) of the system or device.

In this case, because the program code itself read out from the memory device realizes the functions of the above embodiments, such a memory device storing the program code can constitute the present invention.

As memory devices that store program code are, for example, the floppy disk, hard disk, optical disk, optomagnetic disk, CD-ROM, CD-R, magnetic tape, nonvolatile memory card (IC memory card), and ROM (mask ROM or flash EEPROM).

The scope of the invention covers, in addition to the case where the functions of the above embodiments are implemented by executing the program code read out by a computer, the case in which the OS (operating system) running on the computer based on the instructions of the program code realizes the functions of the above embodiments by executing the necessary process in part or in whole.

Furthermore, the scope of the invention covers the case in which program code read out from a memory device is written in memory in a function extension board or unit inserted in or connected to a computer and the CPU of such a board or unit carries out the necessary process in part or in whole to realize the functions described in the above embodiments.

As described above, the present invention constitutes an AC charge current detection circuit so that its detection characteristics can be changed, in order to detect current by switching the AC charge current detection characteristics between the voltage region lower than the discharge threshold voltage and the region higher than that. Then it becomes possible to reduce fluctuations in current detection and prevent such problems that the life of the image carrier becomes short because of excessive discharge due to fluctuations in charging unit characteristics and operating conditions. As a result, the image forming system can maintain high image quality over a long time.

Because the present invention has a plurality of AC charge current detection units of different detection characteristics, it can detect current by appropriately switching the AC charge current detection units between the non-discharge region and discharge region upon detection of AC charge current. As a result, fluctuations in current detection become small and it is thereby possible to reduce fluctuations in current detection and prevent such problems that the life of the image carrier becomes short because of excessive discharge due to fluctuations in charging unit characteristics and operating conditions. Then the image forming system can maintain high image quality over a long time.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An electrophotographic image forming system for forming an electrostatic latent image by applying an AC voltage to a charger contacting an image carrier and thereby charging a surface of the image carrier, comprising:

a detector for detecting an AC charge current by applying the AC voltage to the charger in either a non-discharge region or a discharge region;

a detection characteristic switching unit adapted to switch detection characteristics of said detector between a time when said detector detects an AC charge current in the non-discharge region and a time when said detector detects an AC charge current in the discharge region; and an AC voltage decision unit for deciding an AC charge voltage to be applied to the charger during image formation based on a detected AC charge current in the non-discharge region and a detected AC charge current in the discharge region.

2. The system as set forth in claim 1, wherein a current detection characteristic of a detected AC charge current is switched between a case where an AC voltage no higher than a discharge threshold voltage is applied and a case where an AC voltage no lower than the discharge threshold voltage is applied.

3. The system as set forth in claim 1, wherein, with a discharge threshold voltage being a voltage for initiating a discharge to the image carrier when the DC voltage is applied to the charger, a current running when at least one AC voltage, which are no higher than the discharge threshold voltage, is applied to the charger and a current running when at least two AC voltages, which is no lower than the discharge threshold voltage, are applied thereto are detected during non-image formation.

4. The system as set forth in claim 1, wherein said detector detects a mean value of a half-wave current of the detected AC charge current.

5. An electrophotographic image forming system for forming an electrostatic latent image by applying an AC voltage to a charger contacting an image carrier and thereby charging a surface of the image carrier, comprising:

a first detector that detects an AC charge current in a non-discharge region;

a second detector that has a current detection characteristic different from a current detection characteristic of said first detector and detects an AC charge current in a discharge region; and an AC voltage decision unit that decides an AC charge voltage to be applied to the charger during image formation based on the detection results of said first detector and said second detector.

6. The system as set forth in claim 5, wherein the AC charge voltage is determined from the detection results of said first detector when an AC voltage no higher than a discharge threshold voltage is applied and of said second detector when an AC voltage no lower than the discharge threshold voltage is applied.

7. The system as set forth in claim 5, wherein, with a discharge threshold voltage being a voltage for initiating discharge to the image carrier when the DC voltage is applied to said charger, a current running when at least one AC voltage, which is no higher than the discharge threshold voltage is applied to said charger and the current running when at least two AC voltages, which are no lower than the discharge threshold voltage, are applied thereto are detected during non-image formation.

8. The system as set forth in claim 5, wherein said detector detects a mean value of a half-wave current of the AC charge current.

9. An electrophotographic image forming method of forming an electrostatic latent image by applying AC voltage to a charger contacting an image carrier and thereby charging the surface of the image carrier, comprising:

a first detection step of detecting an AC charge current in a non-discharge region;

a second detection step of detecting an AC charge current in a discharge region using a current detection characteristic different from a current detection characteristic used in the first detection step;

a decision step of deciding an AC charge voltage to be applied to the charger during image formation based on the detection results obtained in the first detection step and the second detection step; and a control step of controlling the decided AC charge voltage to be applied to the charger during image formation.

10. The method as set forth in claim 9, wherein the AC charge voltage is determined from the detection results obtained in the first detection step when an AC voltage, which is no higher than a discharge threshold voltage is applied and in the second detection step when an AC voltage, which is no lower than the discharge threshold voltage is applied.

11. The method as set forth in claim 9, wherein, with a discharge threshold voltage being a voltage for initiating discharge to the image carrier when DC voltage is applied to the charger, a current running when at least one AC voltage, which is no higher than the discharge threshold voltage is applied to the charger and the current running when at least two AC voltages, which are no lower than the discharge threshold voltage are applied thereto are detected during non-image formation.

12. The method as set forth in claim 9, wherein a mean value of a half-wave current of the AC charge current is detected.

13. A storage medium for storing a computer program for controlling electrophotographic image formation that forms an electrostatic latent image by applying AC voltage to a charger contacting an image carrier and thereby charging the surface of the image carrier, wherein the computer program causes a computer to execute:

a first detection step of detecting an AC charge current in a non-discharge region;

a second detection step of detecting an AC charge current in a discharge region using a current detection characteristic different from a current detection characteristic of the first detection step;

a decision step of deciding an AC charge voltage to be applied to the charger during image formation based on the detection results obtained in the first detection step and said second detection step; and a control step of controlling the decided AC charge voltage to be applied to the charger during image formation.

* * * * *

UNITED STATES PATENT AND TRADEMARK OFFICE

CERTIFICATE OF CORRECTION

PATENT NO. : 6,868,241 B2
DATED : March 15, 2005
INVENTOR(S) : Hiroshi Takami

It is certified that error appears in the above-identified patent and that said Letters Patent is hereby corrected as shown below:

Column 6,
Line 26, “roller” should read -- rollers --.

Column 7,
Line 58, “is” should read -- are --.

Column 8,
Line 11, “is” should read -- are --; and
Line 47, “varies” should read -- varying --.

Column 14,
Line 60, “are” should read -- is --; and
Line 62, “is” should read -- are --.

Signed and Sealed this

Nineteenth Day of July, 2005

JON W. DUDAS
*Director of the United States Patent and Trademark Office*